US005728037A

United States Patent [19]

Pryor et al.

[11] Patent Number: 5,728,037

[45] Date of Patent: Mar. 17, 1998

[54] ENVIRONMENTALLY FRIENDLY PINCH BOTTOM BAG ASSEMBLY AND METHOD OF MAKING

[75] Inventors: Arthur M. Pryor; Lattie G. Futch, both of Tifton; Robert W. Bolling, Jr., Savannah, all of Ga.

[73] Assignee: Union Camp Corporation, Princeton, N.J.

[21] Appl. No.: 468,444

[22] Filed: Jun. 6, 1995

Related U.S. Application Data

[60] Division of Ser. No. 146,961, Nov. 10, 1993, Pat. No. 5,529,396, which is a continuation-in-part of Ser. No. 977, 324, Nov. 17, 1992, abandoned.

[51] Int. Cl.[6] ..... B31B 39/00

[52] U.S. Cl. ..... 493/217; 493/255; 493/259

[58] Field of Search ..... 493/210, 217, 493/220, 255, 259, 260

[56] References Cited

U.S. PATENT DOCUMENTS 3,254,574 6/1966 Becker ..... 493/220

3,575,172 4/1971 Kiela .

4,088,264 5/1978 Vogt ..... 493/217

4,353,770 10/1982 Kuckhermann ..... 493/217

*Primary Examiner*—Jack W. Lavinder

*Attorney, Agent, or Firm*—Woodcock Washburn Kurtz Mackiewicz & Norris LLP

[57] ABSTRACT

A method of making a factory end for a bag assembly, in which a removable plastic bag will be contained within a protective outer bag, includes steps of providing a tube assembly having a plastic inner tube within an outer tube; sealing one end of the plastic inner tube so as to be closed at said one end; and closing the outer tube about the closed one end of the inner tube in such a manner that no plastic material from said inner tube is permanently affixed to the outer tube, whereby the outer tube may be efficiently recycled or incinerated after it is separated from the inner tube by a consumer. The bag assembly itself is disclosed as a separate aspect of the invention. Methods for making the tube assemblies are also disclosed.

9 Claims, 13 Drawing Sheets

ENVIRONMENTALLY FRIENDLY PINCH BOTTOM BAG ASSEMBLY AND METHOD OF MAKING

This is a division of application Ser. No. 08/146,961, filed Nov. 11, 1993, now U.S. Pat. No. 5,529,396 which is a CIP of Ser. No. 07/977,324, filed Nov. 17, 1992, now abandoned, the disclosure of which is hereby incorporated by reference.

BACKGROUND OF THE INVENTION

1. Field of the Invention

This invention relates to bag assemblies of the type in which a removable plastic bag or pouch is contained within a protective outer bag. More specifically, this invention relates to multiwall pinch bottom open mouth-type ("PBOM") bag assemblies, which are more adaptable to post-use recycling than such assemblies heretofore known.

2. Description of the Prior Art

Pinch bottom open mouth-type bags, or "PBOM bags," as they are commonly known, are well known to those in the bag manufacturing industry. U.S. Pat. Nos. 3,958,749, 4,353,770, and 4,088,264, among others, discuss PBOM bag assemblies, as well as previously preferred methods for constructing and using the same.

A method of manufacturing a PBOM bag assembly that is described in U.S. Pat. No. 4,088,264 to Vogt involves processing a tubed bag blank that has an inner plastic tube contained within and spot-pasted to a multi-layered outer paper tube. In this process, the lower end of the inner plastic tube is first heat sealed closed by applying heat to a portion of the lower tube that is near, but not at, its bottom. The heat sealed portion is then severed by a pair of scoring rollers while the plastic film is still hot. After such severing, the lower-most portion of the severed plastic tube is still secured to the bottom of the outer paper tube by spot pasting, but is no longer connected in anyway to the upper portion of the plastic inner tube. The lower end of the outer tube is then folded over and glued in the manner that is characteristic to PBOM bags, trapping the lower-most portion of the plastic inner tube within the foldover. The severing of the inner plastic tube, then, permits the eventual removal of the inner plastic bag from the protective paper outer bag by a consumer, as it prevents the lower end of the plastic bag from becoming trapped within the folded-over end of the protective outer bag.

Unfortunately, the presence of the severed lower end portion of the inner plastic tube within the foldover of the protective outer bag makes the protective outer bag difficult to recycle after it has been discarded by the consumer. Before the outer bag can be recycled, all plastic remnants within the foldover must be removed by hand.

It is clear that there has existed a long and unfilled need in the prior art for an improved pinched bottom bag in which a removable plastic bag is contained within a protective outer bag, and a corresponding method of manufacture, that will not contain or create any scraps or remnants of plastic in the protective outer bag once the removable plastic bag has been pulled out, or vice versa.

SUMMARY OF THE INVENTION

Accordingly, it is an object of the invention to provide an improved Winch bottom bag assembly, in which a removable plastic bag is contained within a protective outer bag, that will not leave any plastic scraps trapped within the protective outer bag once the plastic inner bag has been removed from the outer bag.

A further object of the invention is to provide an improved method of manufacturing a pinch bottom bag assembly in which a removable plastic bag is contained within a protective outer bag, which will not cause any plastic material to be separated from the inner bag and trapped within the outer bag during manufacture.

In order to achieve the above and other objects of the invention, a method of making a factory end for a bag assembly in which a removable plastic bag will be contained within a protective outer bag includes, according to a first aspect of the invention, the steps of providing a tube assembly having a plastic inner tube within an outer tube; sealing one end of the plastic inner tube so as to be closed at one end; and closing the outer tube about the closed one end of the inner tube in such a manner that no plastic material from the inner tube is permanently affixed to the outer tube, whereby the outer tube may be efficiently recycled or incinerated after it is separated from the inner tube by the consumer.

An environmentally-friendly sack assembly according to a second aspect of the invention which is ready to be filled with material and closed for shipment to a consumer, includes a plastic inner tube which is closed at one end thereof; and an outer tube provided around the inner tube, the outer tube being closed at a first end thereof which corresponds to the one end of the inner tube, the closed first end being constructed and arranged so that no plastic material from the inner tube will be retained in the closed first end when the filled inner tube is removed from the outer tube by a consumer.

A method of making bag blanks for a bag assembly in which a removable plastic bag will be contained within a protective outer bag, includes, according to a third aspect of the invention, the steps of perforating a second sheet of non-plastic material in a straight-line pattern together with a first sheet of plastic material; perforating a third sheet of non-plastic material in a stepped pattern separately from said first and second sheets; advancing the perforated first, second, and third sheets to a point where the first, second, and third sheets are juxtaposed, the first and second sheets being advanced to said point of juxtaposition along paths having different lengths, whereby the straight-line perforation pattern on said first sheet will be spaced from that of the second sheet at the point of juxtaposition; tubing the juxtaposed first, second, and third sheets; and separating bag blanks from the tubed sheets along the perforated patterns, whereby each of the bag blanks will have an outer ply with a pair of stepped opposite ends.

A fourth aspect of the invention involves a system for performing the above-described bag blank making method.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
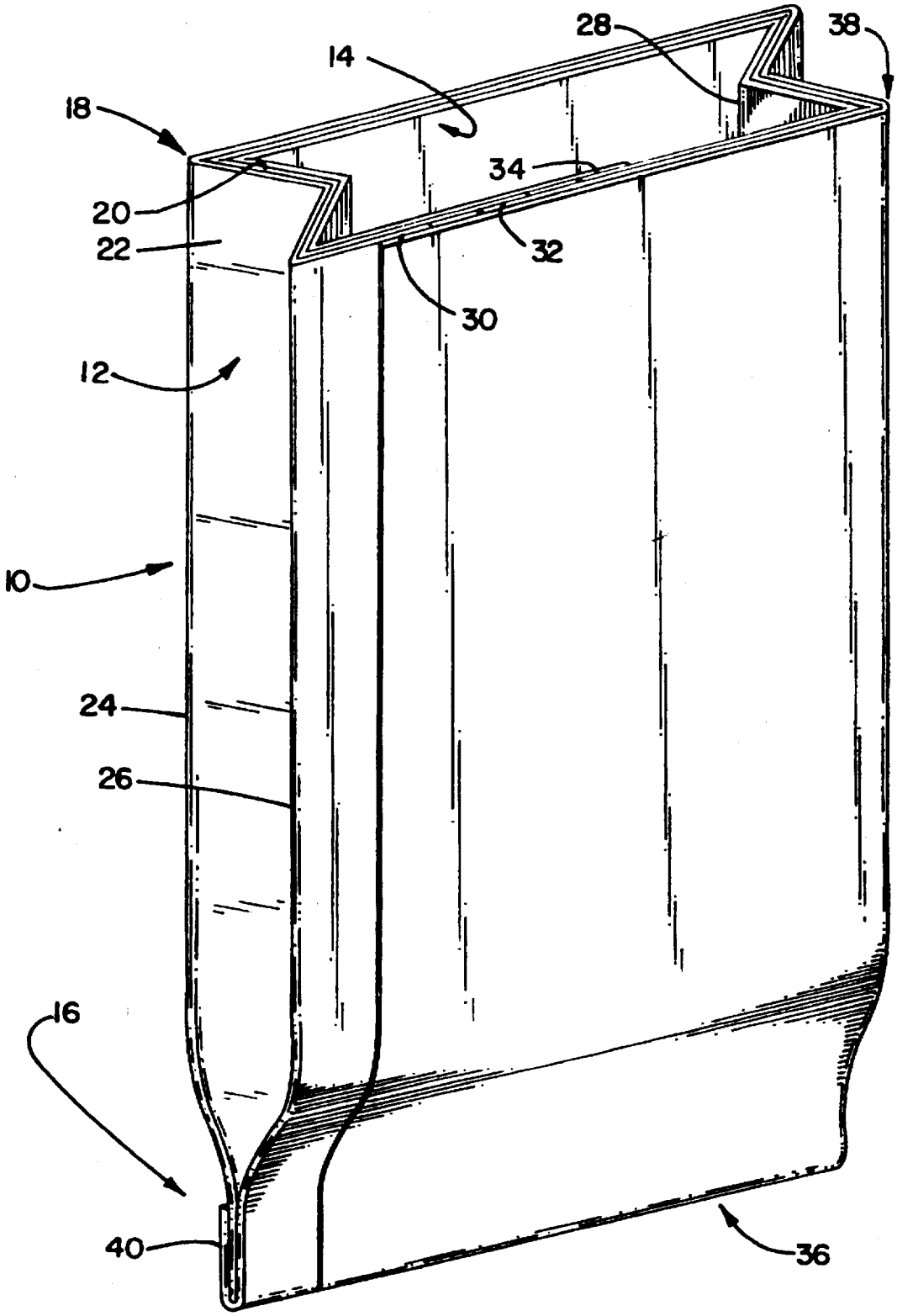
FIG. 1 is a perspective view of an environmentally friendly bag assembly that is constructed according to a preferred embodiment of the invention.

Referring now to the drawings, wherein like reference numerals designate corresponding structure throughout the views, and referring in particular to FIG. 1, a bag assembly 10 which is ready to be filled with material and closed for shipment to a consumer includes an outer tube 12 and a plastic inner tube 14. Preferably, inner tube 14 is fabricated from a heat-sealable plastic material such as polyethylene.

Bag assembly 10 includes a first or factory end 16, which is sealed closed at the factory that manufactures bag assembly 10, as will be described in greater detail below. Bag assembly 10 further includes a second, customer end 18 which remains open and unsealed when shipped from the factory which makes the bag assembly 10 to a customer, which is usually a manufacturer that desires to package and transport loose material to a consumer. A consumer, as defined herein, is a company or individual who removes the material from the bag assembly 10, and discards bag assembly 10 for incineration or recycling.

As may be seen on the customer end 18 of the bag assembly 10 depicted in FIG. 1, and as will be described in detail below with reference to the other figures depicting manufacturing of the bag assembly 10, outer tube 12 preferably includes at least a first ply 22 and a second ply 20 of a non-plastic material, preferably kraft paper. As may be seen in FIG. 1, second ply 20 is shaped as a tube surrounding the inner tube 14, and first ply 22, also shaped as a tube, is positioned about second ply 20. It should be understood that the invention described in the appended claims is not limited to bag assemblies 10 having only two non-plastic plies, and that as many plies 20, 22, etc. as are necessary may be used to give outer tube 12 the desired strength and toughness characteristics.

Bag assembly 10 is also gussetted, as may be seen in FIG. 1. Each gussetted wall of bag assembly 10 includes an outer pair of fold lines 24, 26 defined in each of inner tube 14 and outer tube 12. The gussetted side walls of bag assembly 10 further include an internal fold line 28, also defined in both inner tube 14 and outer tube 12.

It should be noted that the invention has equal utility for use with non-gussetted or flat bags. The preferred embodiment, however, uses a gussetted bag design.

As may further be seen in FIG. 1, both first ply 22 and second ply 20 of outer tube 12 are formed by sheets of non-plastic material into the illustrated tube configuration. Inner tube 14, likewise, has been so fashioned from a sheet of plastic material. Accordingly, first and second plies 22, 20 of outer tube 12 include longitudinal seams 32, 30, which represent where the respective ends of the sheet material have been joined together with an adhesive. Inner tube 14, similarly, includes a longitudinal seam 34.

Figure 6:
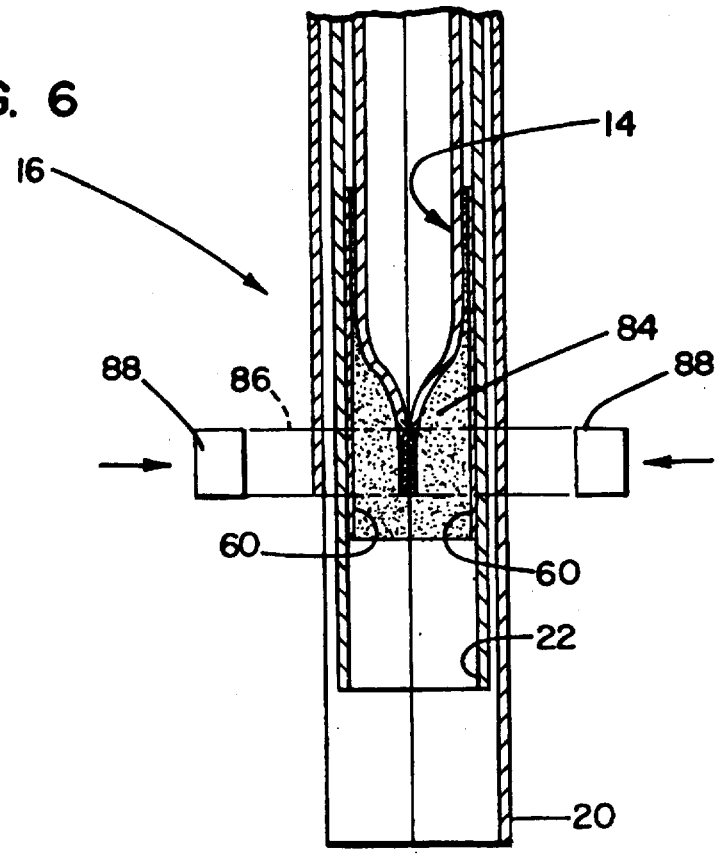
FIG. 6 is a diagrammatical view depicting a heat sealing step which is preferably performed on the bag blank depicted in FIGS. 4 and 5.
Figure 7:
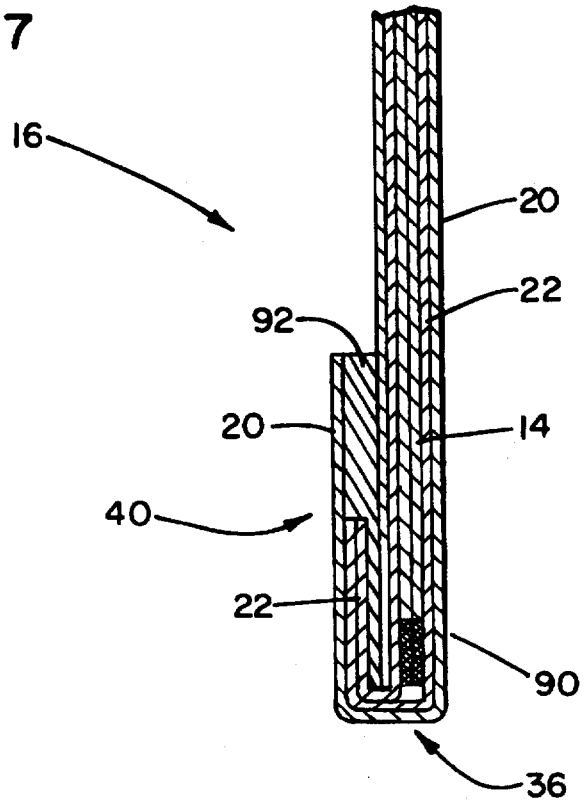
FIG. 7 is a diagrammatical view depicting a foldover step which is performed on the bag blank.

Referring briefly to FIG. 7, it will be seen that the first, factory end 16 of bag assembly 10 includes a lip portion 40 at a first, bottom end 36 of outer tube 12, which has been folded over and sealed to itself by an adhesive 92 so as to close the first, bottom end 36 of outer tube 12, and thus, the factory end 16 of bag assembly 10. As may further be seen in FIG. 6, one bottom end 90 of inner tube 14 is melt-sealed together so as to close the lower end of inner tube 14. It is important to note that the closed bottom end 90 of inner tube 14 is positioned at the very end of inner tube 14, and, particularly, that none of the plastic inner tube 14 is folded with, trapped within, or otherwise permanently attached to the folded over lip portion 40 of outer tube 12.

Figure 2:
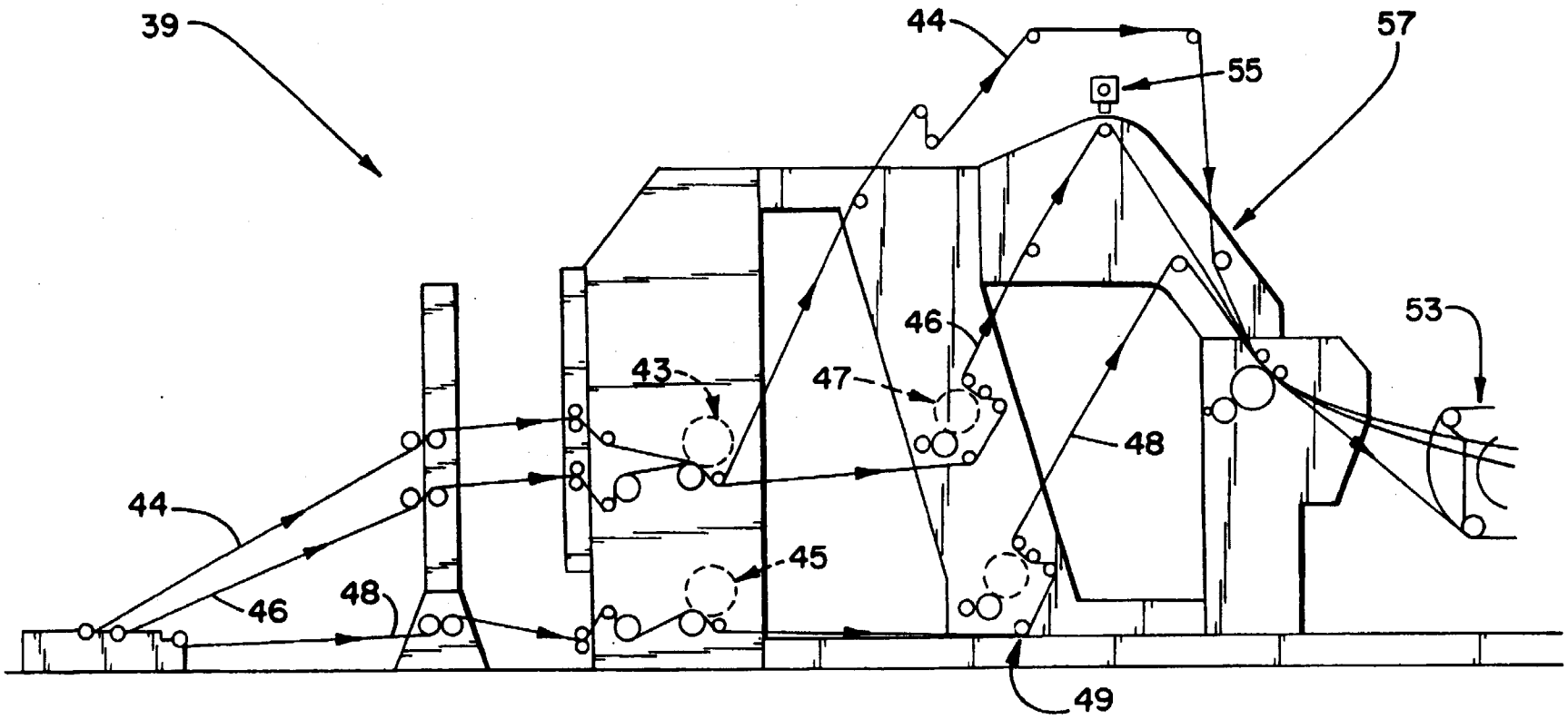
FIG. 2 is a diagrammatical view depicting part of a preferred method for manufacturing bag blanks according to the invention.

Referring now to FIGS. 2–13, the preferred method for manufacturing a bag assembly 10 as depicted in FIG. 1 will now be described. FIG. 2 shows a web processing system 39 into which a first plastic sheet 44, a second non-plastic sheet 46, and a third non-plastic sheet 48 are introduced. As may be seen in FIG. 2, sheets 44, 46 are perforated together by a first perforation roller 43, and sheet 48 is perforated by itself by means of a second perforation roller 45. The respective perforation patterns formed by rollers 43, 45 will be discussed above with reference to FIG. 3. System 39 further includes release coat application unit 47, spot pasting unit 49 and a tubing unit 53, which is positioned subsequent to a point 57 at which the three sheets 44, 46, 48 are juxtaposed for pasting and tubing.

Figure 3:
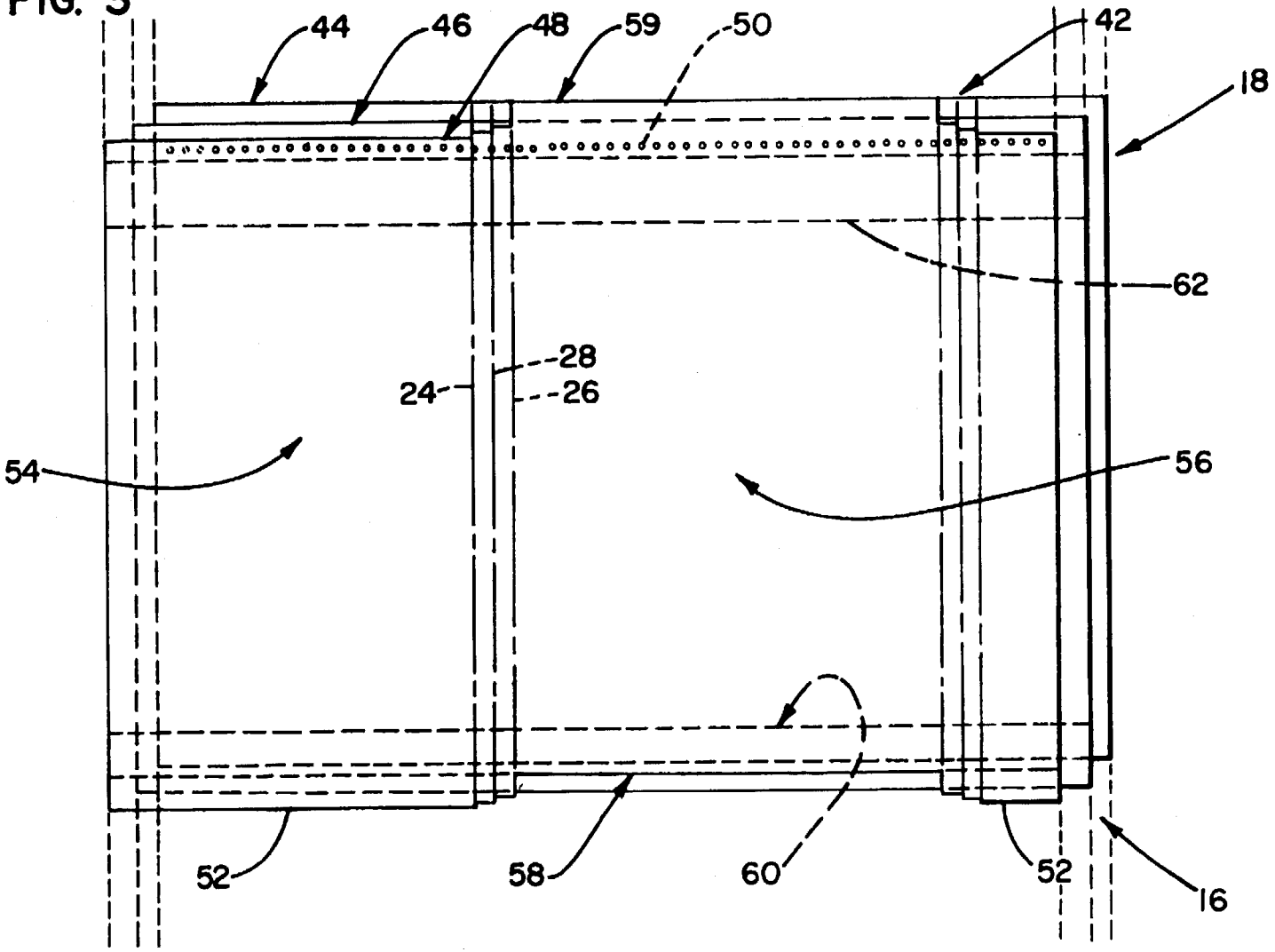
FIG. 3 is a diagrammatical top plan view of three different sheets of material, shown superimposed, which are used to form the improved bag assembly depicted in FIG. 1.

FIG. 3 depicts a group 42 of continuous bag blank sheets shown juxtaposed prior to tubing but after the point 57 of juxtaposition. Specifically, FIG. 3 depicts the third sheet 48 of non-plastic material positioned above the second non-plastic sheet 46, which in turn is positioned above the first sheet 44 of plastic material. The sheets 44, 46, 48 are shown isolated in the perforated configuration along which they will eventually be separated, for purposes of clarity, though it should be understood that each of the three sheets is still continuous with like material in the vertical direction at this point.

Sheets 46, 48 are secured together in a predetermined registered position by means of a starch-type water-based spot paste 51, as may be seen in FIG. 2. Spot paste 51 is applied by spot pasting unit 49, shown in FIG. 2. Sheets 44, 46 are secured together by a hot-melt adhesive 50, which is applied at station 55, also shown in FIG. 2. Preferably, hot-melt adhesive 50 is a hydrocarbon and/or oxygenated hydrocarbon polymer-based adhesive such as for example EASTOBOND® A-8 brand hot melt adhesive which is from Eastman Chemical Products Inc., Kingsport, Tenn.

An area 54 on the third, non-plastic sheet 48 which, after tubing, will correspond with a first side of outer tube 12, includes a protruding tab portion 52 at a bottom, factory end 16. Tab portion 52 is so defined by a stepped perforation pattern created by first perforation roller 45. The purpose of tab portion 52 is to form the lip portion 40 which will be folded over at the factory end 16, as is previously described with reference to FIGS. 1, 8 and 7. Since bag blanks 42 are formed from continuous sheets, there will be a corresponding recess or notch at the opposite, customer end 18 of the third sheet 48. A first stepped edge 58 at the factory end 16 of sheet 48 thus includes tab portions 52. A second stepped edge 59 at the customer end 18 of sheet 48 includes a recess from which material has been taken to form a tab portion 52 for an adjacent bag blank. Sheets 44, 46 are not formed with such tab portions, and, rather, are perforated by roller 43 so as to be separated from the continuous sheet as a simple rectangular shape.

According to one important aspect of the invention, system 39 is configured so as to advance sheet 44 along a longer path from roller 43 to juxtaposition point 57 than the path sheet 46 is advanced along. This, as may be seen in FIG. 3, spaces the respective perforation lines in sheets 44, 46 from each other, for purposes that will be described hereinbelow.

Referring again to FIG. 3, it will be seen that a first release coat 60 of silicone-based material is applied by release coat application unit 47 as a horizontal strip to the lower surface of second sheet 46. Preferably, the release coat comprises a thermoplastic polymer and a siloxane polymer. Most preferably, release coat 60 is a compound having a base of polyvinyl acetate with about 30 percent silicone plus a catalyst such as stock number PCL-PC9 4 catalyst, which is available from Rhone-Poulenc. Alternatively, any material which will not adhere to plastic when the plastic is melted could be used for release coat 60. A second strip of release coat 62, also applied to a lower surface of second non-plastic sheet 46 by unit 47, is positioned horizontally toward the customer end 18, as is clearly shown in FIG. 3. Release coat 62 is preferably of the same material as release coat 60. The purpose of release coats 60, 62 are to stop the plastic material 44 from adhering to the non-plastic surface of second sheet 46, and vice versa, when heat is applied through second and third non-plastic sheets 46, 48 to effect heat sealing of plastic material 44, as will described in greater detail below.

Figure 4:
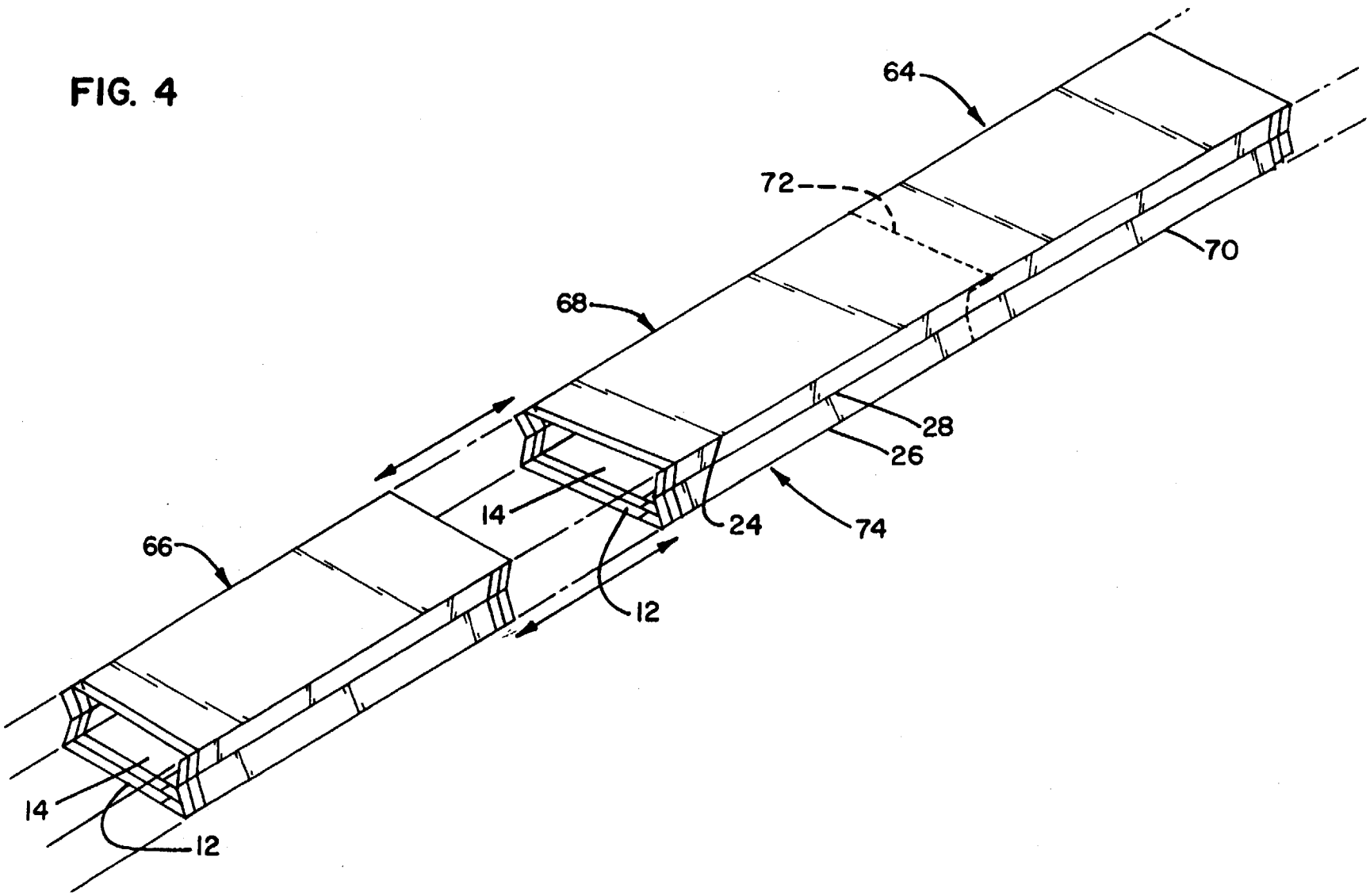
FIG. 4 is a perspective diagrammatical view which depicts two blanks being separated according to a preferred method for manufacturing the bag assembly depicted in FIG. 1.

FIG. 4 depicts a series or group 64 of the bag blanks 42 illustrated in FIG. 3, after tubing has been performed thereon. The tubing process is well known to those skilled in the bag manufacturing industry. The group 64 of tube blanks includes a first tube blank 66, a second tube blank 68, and third tube blank 70. First tube blank 66 is shown after separation from the second tube blank 68. The second tube blank 68 is shown still attached to third tube blank 70. As may be seen in FIG. 4, second tube blank 68 is joined to third tube blank 70 by a series of perforated edges 72, which define the borders or points of predetermined separation between the respective sheets 44, 46, 48 in the different tube blanks 68, 70. When tension is applied between adjacent tube blanks, such as tube blanks 66, 68 as shown in FIG. 4, perforated edges 72 will separate. The gussetted sides 74 of the respective blanks 66, 68, 70 are clearly shown in FIG. 4, as are the component fold lines 24, 26, 28.

Figure 5:
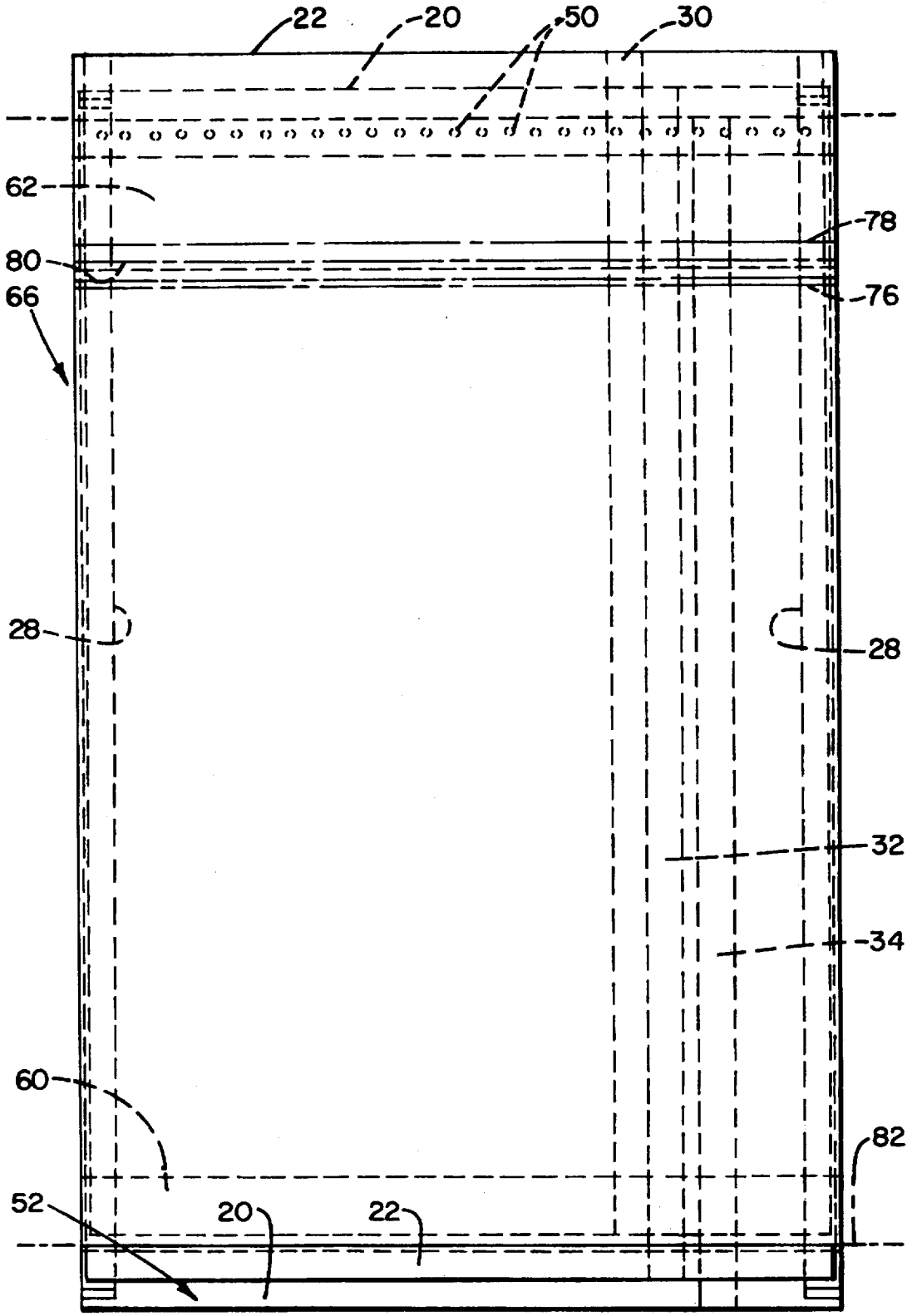
FIG. 5 is a front elevational view of one of the bag blanks depicted in FIG. 4.
Figure 8:
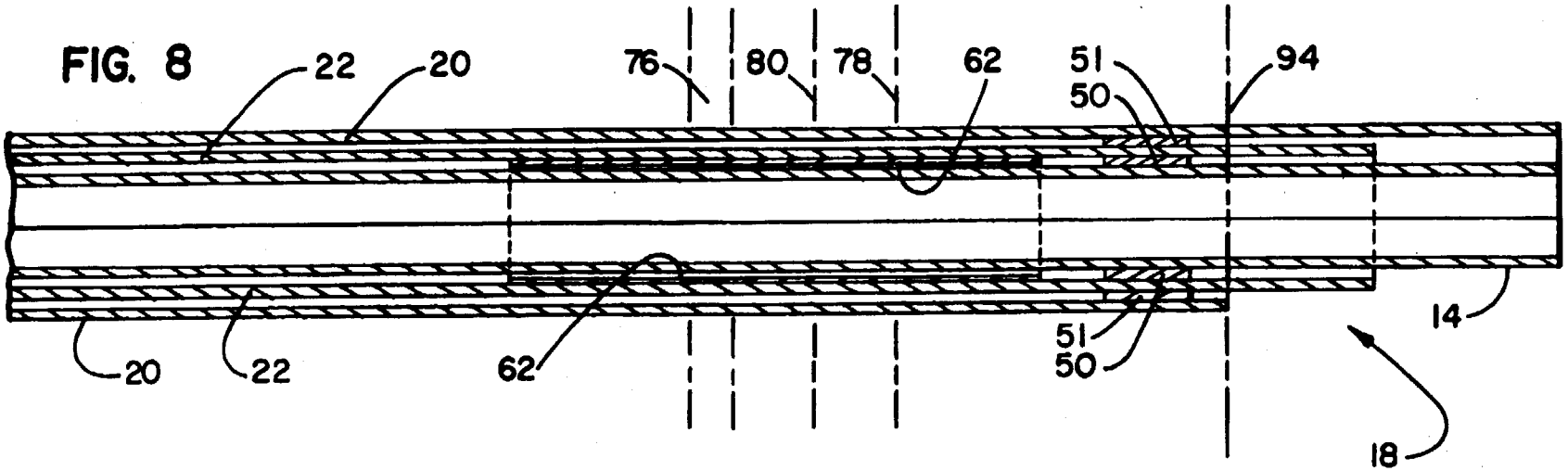
FIG. 8 is a cross-sectional fragmentary view of a customer end of the bag blank which is depicted in FIG. 5.
Figure 9:
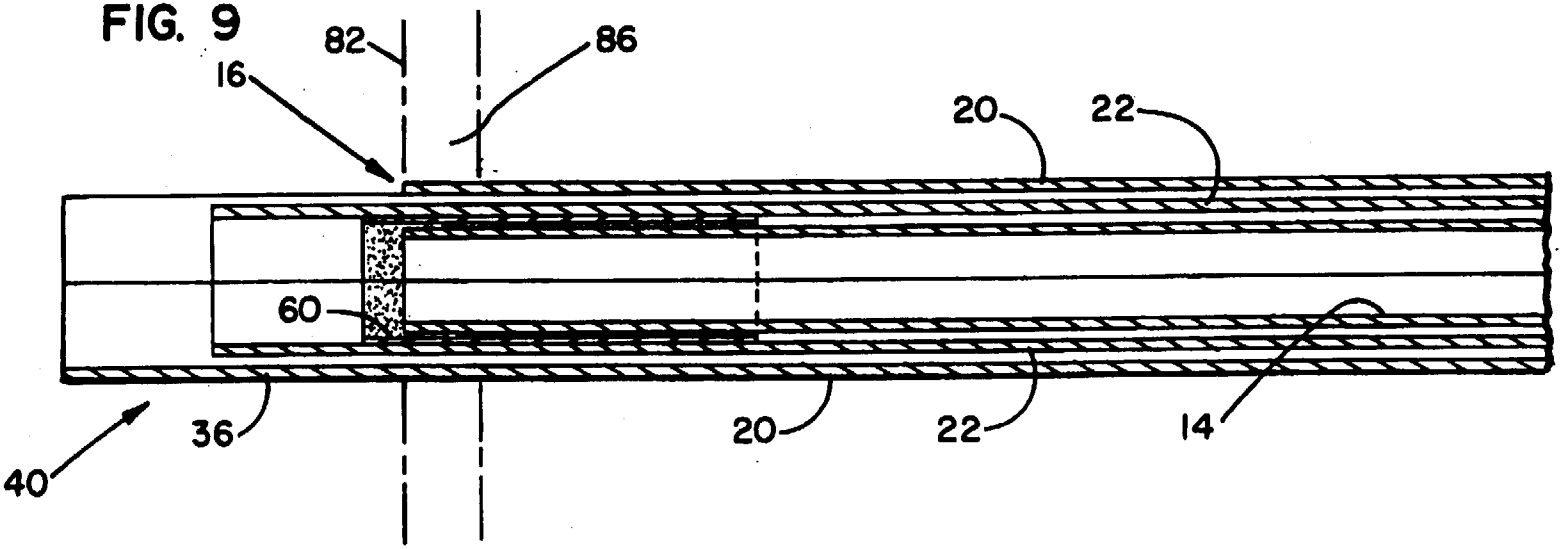
FIG. 9 is a fragmentary cross sectional view of a factory end of the bag blank which is depicted in FIG. 5.

FIG. 5 is a side elevational view of tube blank 66 after separation. FIGS. 8 and 9 are fragmentary cross-sectional views depicting, respectively, the customer end 18 and factory end 16 of tube blank 66. Referring first to the factory end 16 depicted in FIG. 9, numeral 86 identifies a factory end heat sealed zone at which heat will be applied to first and second plies 22, 20 of outer tube 12 to heat seal the bottom end of plastic inner tube 14 closed. Numeral 82 identifies the approximate point at which lip portion 40 will be folded over to close the first, bottom end 36 of outer tube 12. As may be clearly seen in FIG. 9, factory heat seal zone 86 is positioned in registry with first release coating 60, so that heat which is transferred through first and second paper plies 22, 20 will be transferred through the coating 60, preventing unwanted adherence between the plastic material in tube 14 to the non-plastic material in first ply 22.

Referring now to FIGS. 5 and 8, the customer end 18 of tube blank 66 includes a customer heat seal zone 76, at which a customer may seal a second, opposite end of inner tube 14 closed after filling inner tube 14 with material. It will be seen that customer heat seal zone 76 is also in registry with the second release coat 62, so that heat applied thereto will not cause unwanted adherence between first paper ply 22 and inner tube 14. Customer end 18 further includes a factory trim location 94 at which tube blank 66 is cut prior to leaving the factory for shipment to the customer. The spot paste 51 and hot melt adhesive 50 are also depicted in FIG. 8. Customer end 18 further includes a customer trim location 78, and a customer sew location 80, the purpose of which will be described in greater detail below.

Referring now to FIG. 6, the processing of factory end 16 will now be described. As may be seen in FIG. 6, a pair of heat applicators 88, which may be heated metal bars or other structure, are applied against the outer surfaces of outer tube 12 to transfer heat, through release coating 60, to the lower most portion of inner tube 14 to melt the lower portion of inner tube 14 together. This closes the bottom end 84 of inner tube 14. Again, the presence of release coating 60 stops the plastic material from the bottom end 84 of inner tube 14 from adhering to the non-plastic material of first paper ply 22, and vice versa, during this process.

As may be seen in FIGS. 9 and 7, the lip portion 40 is then folded at fold line 82 over onto itself, and is sealed in this position with a hot melt adhesive 92. It will be noted that the closed end 90 at bottom end 84 of inner tube 14 does not become trapped or otherwise adhered to the folded-over portion 40 of outer tube 12 during this step.

At this point, while tube blank 66 is still at the factory, the customer end 18 is trimmed at the trim location 94, as shown in FIG. 8. The bag assembly 10 depicted in FIG. 1 is shown after such trimming. After trimming, bag assembly 10 may be shipped to the customer for filling and subsequent sealing of the customer end 18.

Figure 10:
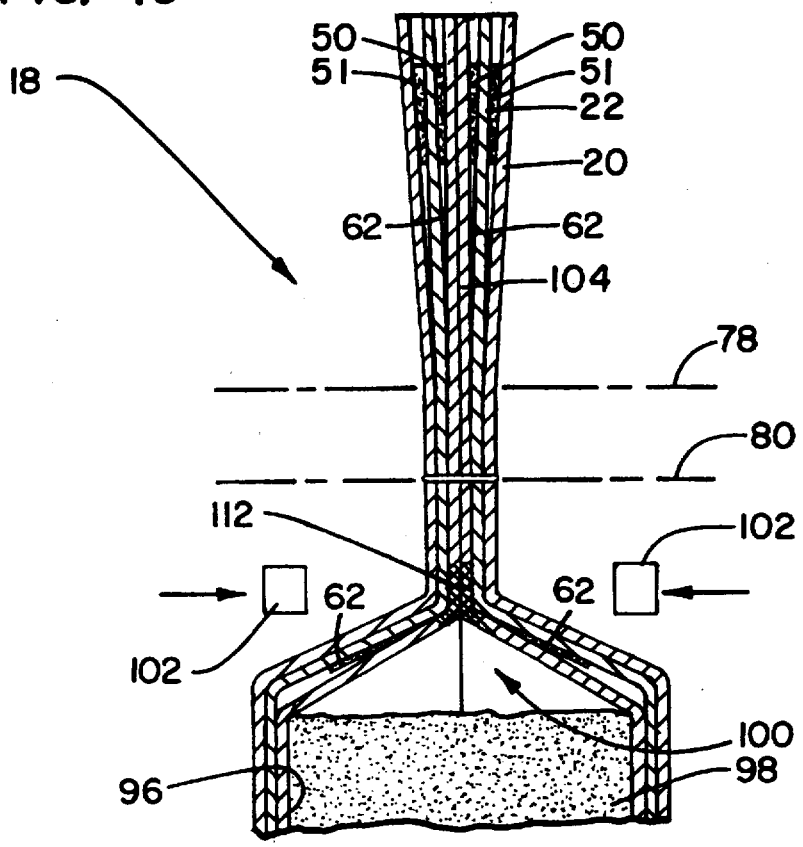
FIG. 10 is a diagrammatical view depicting operations which are performed on the customer end of the bag assembly depicted in FIG. 1.

FIG. 10 depicts processing of the customer end 18 of bag assembly 10 by a customer after inner tube 14 has been filled with a material 98. After filling, a pair of heat applicators 102 are applied at customer heat seal zone 76 to the upper end 100 of inner tube 14 to create a heat sealed end area 112, thereby closing the upper end 100, and, by definition, transforming inner tube 14 into a plastic bag 96.

Figure 11:
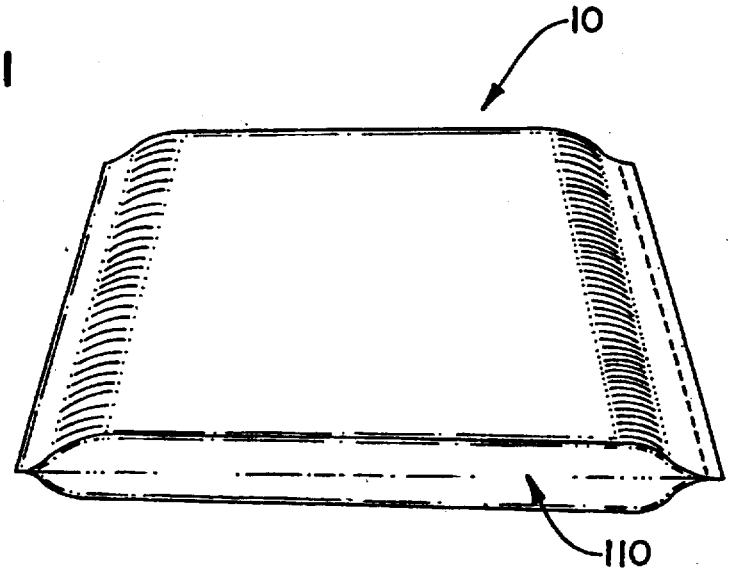
FIG. 11 is a perspective view of a filled and sealed bag assembly according to the invention, in condition to be shipped to a consumer.

After the heat sealing step, customer end 18 is then trimmed by the customer at location 78. A sew strip may then be placed over the trimmed upper end, near the point indicated by numeral 108, and sewn to the upper end at location 80 by a thread 106. At this point, the bag assembly 10 may be shipped with the material 98 to a consumer. The finished bag assembly is depicted in FIG. 11.

Figure 12:
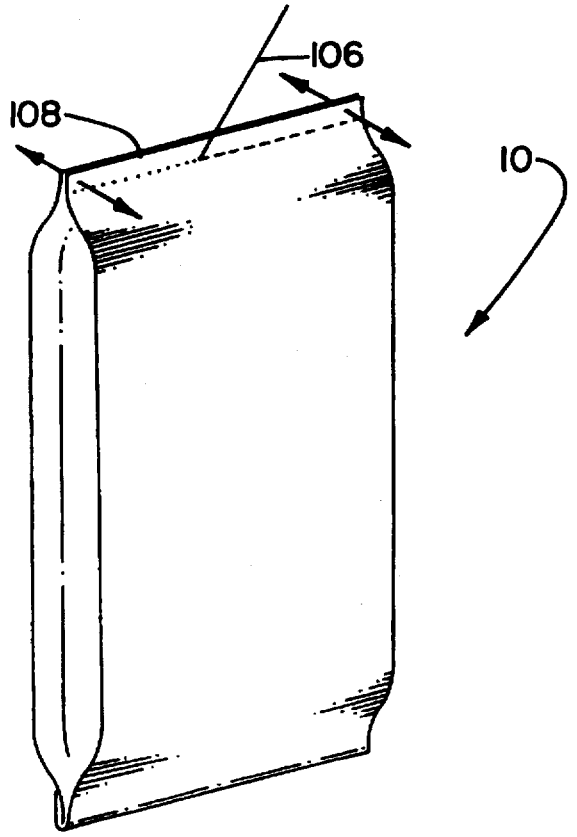
FIG. 12 is a perspective view depicting a consumer opening the customer end of the bag assembly depicted in FIG. 11.
Figure 13:
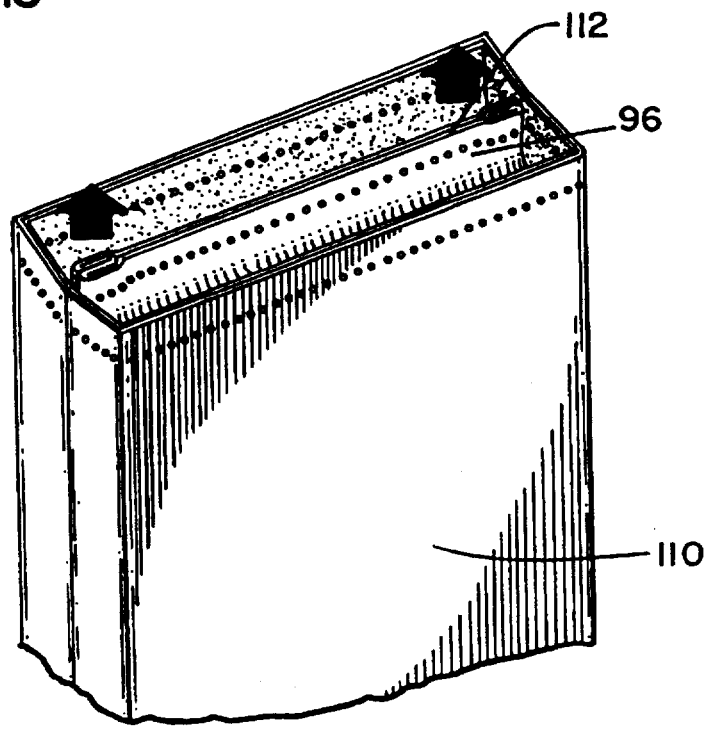
FIG. 13 is a perspective diagrammatical view depicting the outer sack of the bag assembly shown in FIGS. 11 and 12 being opened up and the sealed liner plastic bag being removed.

To remove the material 98 from the bag assembly 10, the consumer removes thread 106, which is sewn in such a way to pull out easily. This step is shown in FIG. 12. The protective outer sack 110 which is formed from the first and second plies 22, 20 may then be pulled open, as is shown in FIG. 13. The plastic inner sack 96 is then removed by pulling it upwardly with respect to the outer sack 110, as is also shown in FIG. 13. After the material 98 has been removed from the plastic inner sack 96, the plastic inner sack 96 may be recycled along with other plastic materials. Due to the presence of the first and second release coats 60, 62 during the heat sealing process, no paper fibers are expected to adhere to the plastic material in bag 96, which will make the recycling process more efficient.

Likewise, the presence of release coats 60, 62 will prevent plastic from adhering to the non-plastic material in the protective outer sack 110. Perhaps even more importantly, no scraps or remnants of the plastic material are adhered to the protective outer sack 110 after the plastic inner sack 96 has been removed. This stands in contrast with pinch bottom bag assemblies that are manufactured according to conventional processes, in which plastic material was, by design, trapped within the lower fold of the pinch bottom of the protective outer sack.

Figure 14:
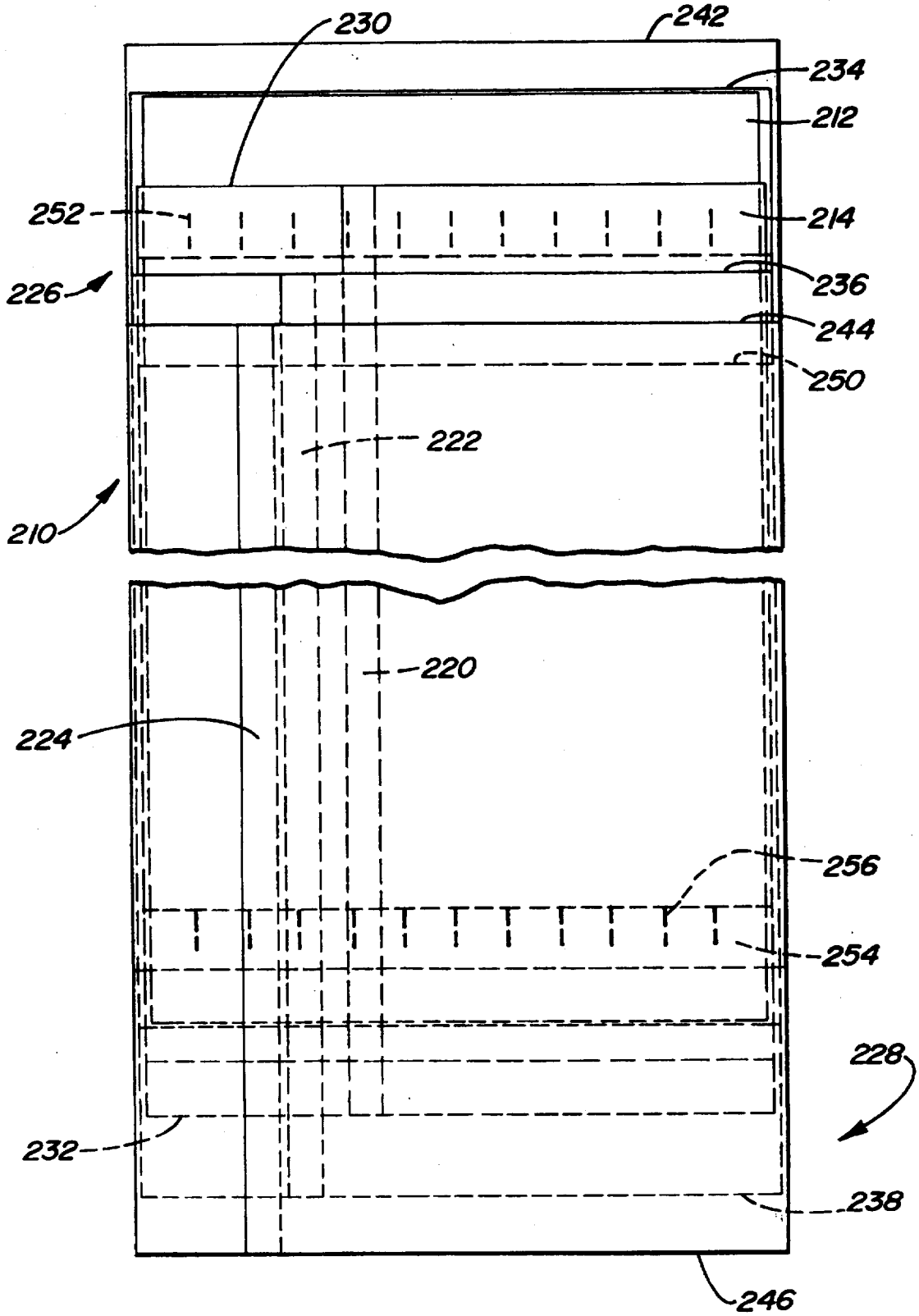
FIG. 14 is a front elevational view of a bag blank constructed according to a second embodiment of the invention.
Figure 15:
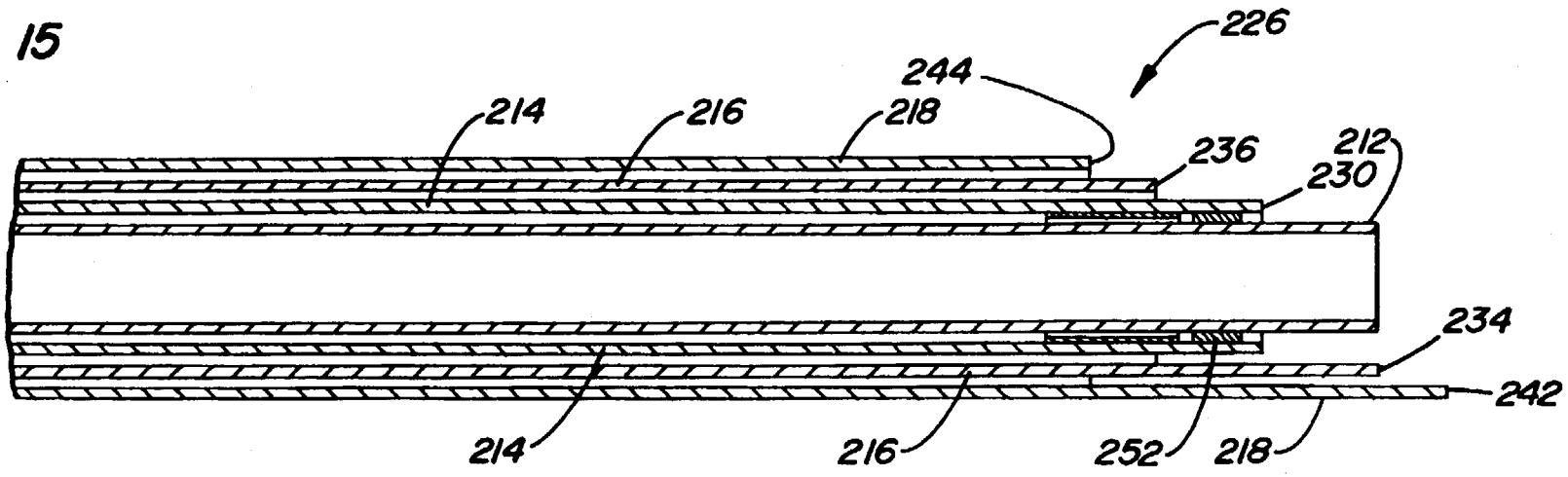
FIG. 15 is a fragmentary cross-sectional view through a factory end of the bag blank depicted in FIG. 14.
Figure 16:
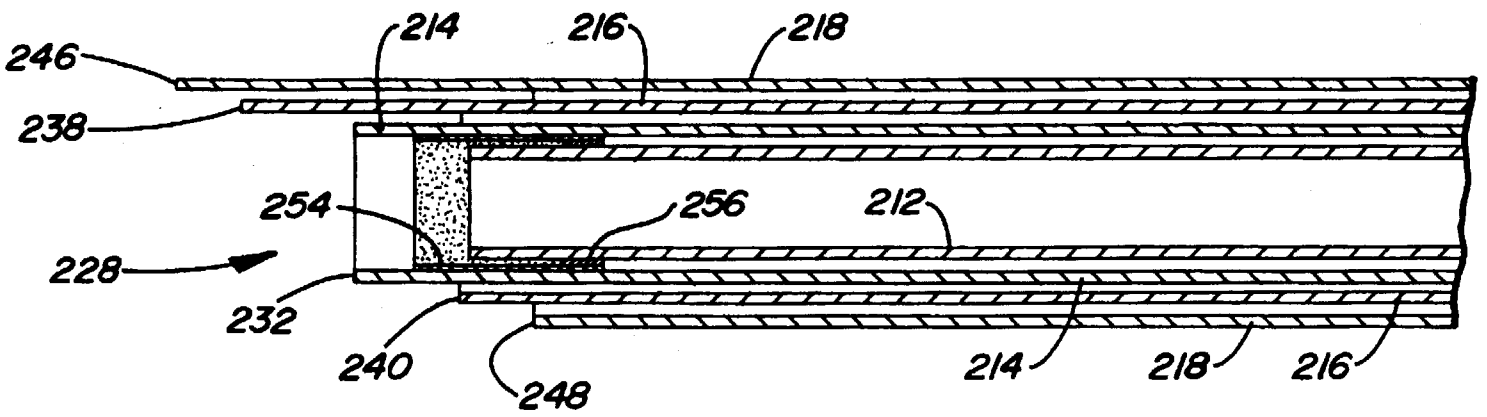
FIG. 16 is a fragmentary cross-sectional view taken through a customer end portion of the bag blank depicted in FIG. 14.

A tube blank 210 that is constructed according to a second preferred embodiment of the invention is illustrated in FIGS. 14–19. Turning first to FIGS. 14, 15 and 16, tube blank 210 includes a thermoplastic inner tube 212. Tube blank 210 further includes an outer tube that includes a first ply 214 of a non-plastic material that is tubed about inner tube 212, a second ply 216 of non-plastic material that is tubed about first ply 214, and a third ply 218 of non-plastic material that is tubed about second ply 216. The first, second and third plies of non-plastic material of the outer tube are, in the most preferred embodiment, fabricated from kraft paper. As shown in FIG. 14, tubed first, second and third plies 214, 216, 218 have longitudinal seams 220, 222, 224, respectively.

As shown in FIGS. 14–16, tube blank 210 includes a first factory end 226 that is constructed and arranged to be, as will be described in greater detail below, closed and sealed at a factory that manufactures the tube blank 210. Tube blank 210 further includes a second, customer end 228 that will remain open and unsealed when shipped from the factory to a customer, who is usually a manufacturer that desires to package loose material and transport the packaged loose material to a final consumer. A consumer, as defined herein, is a company or individual who removes the loose material from its packaging.

As may be seen in FIGS. 14–16, the first ply 214 of non-plastic material has a first edge 230 at the factory end 226 of tube blank 210. First factory edge 230 is unstepped, meaning that the upper side of first ply 214 is substantially flush with the lower side of first ply 214 when viewed as shown in FIG. 15. First ply 214 has a second edge 232 at the opposite, customer end 228 that is also unstepped. At the factory end 226 of tube blank 210, the inner tube 212 protrudes beyond the factory edge 230 of first ply 214. At the customer end 228 of tube blank 210, the customer edge 232 of first ply 214 extends beyond the customer end of inner tube 212. The first ply 214 is secured to inner tube 212 at factory end 226 by a hot melt spot paste 252 that is applied to the inner surface of first inner ply 214 and bonds to the outer surface of inner tube 212 at spaced locations about the periphery of inner tube 212. The hot melt spot paste 252 is preferably applied as close as possible to the factory edge 230 of the first ply 214, as may best be seen in FIG. 15. Preferably, hot melt spot paste 252 is ethylene vinyl acetate copolymer based adhesive such as is available from Port City of Wilmington, N.C. under the trade name HOT MELT ADHESIVE 272. As may further be seen in FIG. 15, a release coat 250 is coated onto the inner surface of first ply 214 inwardly of the spot pasting 252 at factory end 226. Release coat 250 is preferably fabricated in the same manner that is described above with reference to the release coats in the first embodiment, although alternative coatings that have similar release characteristics could be used instead.

Second ply 216 is, again, tubed about first ply 214 and is stepped at both factory end 226 and customer end 228. In other words, as may be seen in FIGS. 15 and 16, second ply 216 has a lower factory end edge 234 that extends outwardly at factory end 226 with respect to an upper factory end edge 236. In the most preferred embodiment, the lower factory end edge 234 of second ply 216 is substantially flush with the end of inner tube 212, and upper factory end edge 236 is positioned inwardly with respect to the factory end edge 230 of first ply 214. At its opposite end, at customer end 228, second ply 216 has an upper customer end edge 238 that extends beyond a lower customer end edge 240. The upper customer end edge 238 of second ply 216 preferably extends outwardly with respect to the customer end edge 232 of first ply 214, and the lower customer end edge 240 preferably is inward of the customer end edge 232 of first ply 214. Similarly, third ply 218 includes a lower factory end edge 242, and an upper factory end edge 244. The lower factory end edge 242 preferably extends outwardly with respect to the lower factory end edge 234 of second ply 216, and the upper factory edge 244 preferably extends inwardly with respect to the upper factory end edge 236 of second ply 216.

As may best be seen in FIG. 16, a second release coat 254 is adhered to an inner surface of first ply 214 at customer end 228. A low-tack spot paste 256 is further provided at customer end 228 to releasably fasten inner tube 212 to the inner surface of ply 214 by applying it directly to release coat 254. By applying spot paste 256 to the release coat 254 instead of directly to the paper material, the inner tube 212 is lightly tacked to first ply 214. Release coat 254 is formed of the same material that is discussed above with reference to the release coats in the first embodiment.

Tube blank 210 is fabricated according to a method that is similar to that described above with reference to the first embodiment, although an additional paper ply is provided and the shape of the untubed plies is different. Those skilled in the art will recognize the modifications in tooling dimensions and the like that would be necessary to manufacture tube blank 210.

Figure 17:
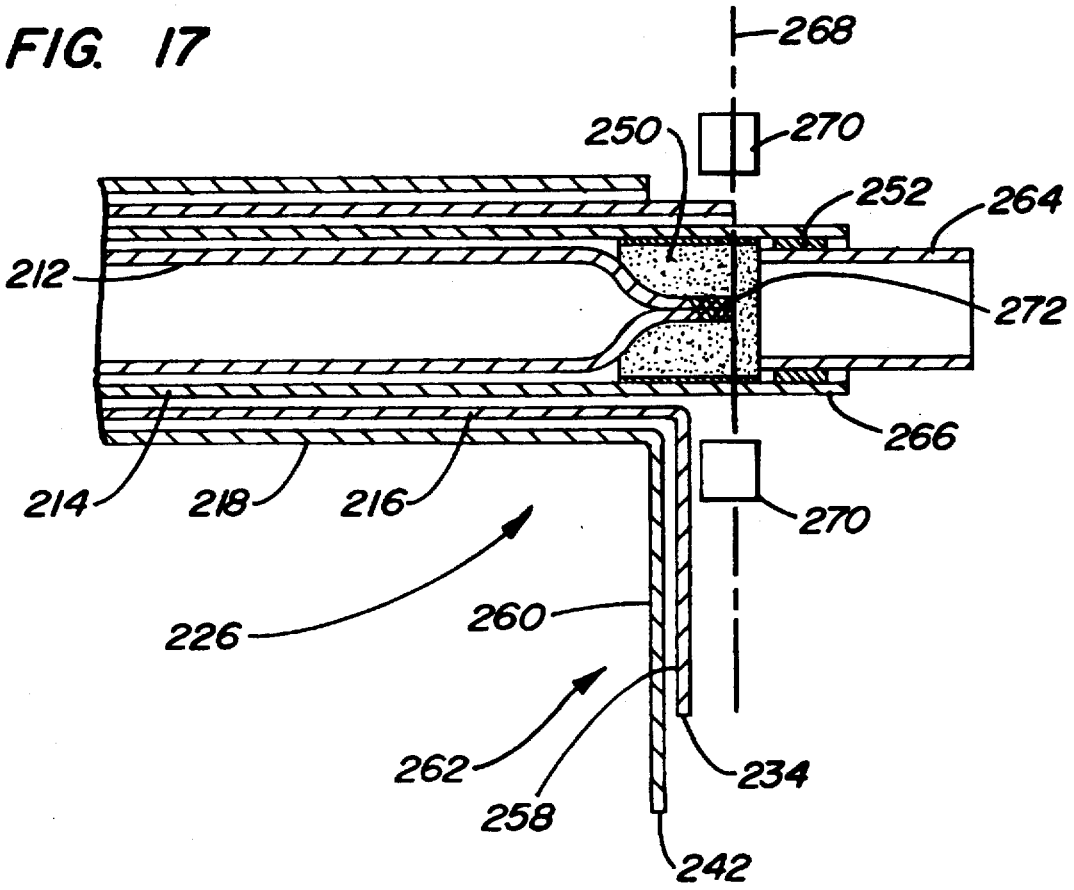
FIG. 17 is a diagrammatical cross-sectional fragmentary view depicting process steps that are performed, according to the invention, on the factory end depicted in FIG. 15.
Figure 18:
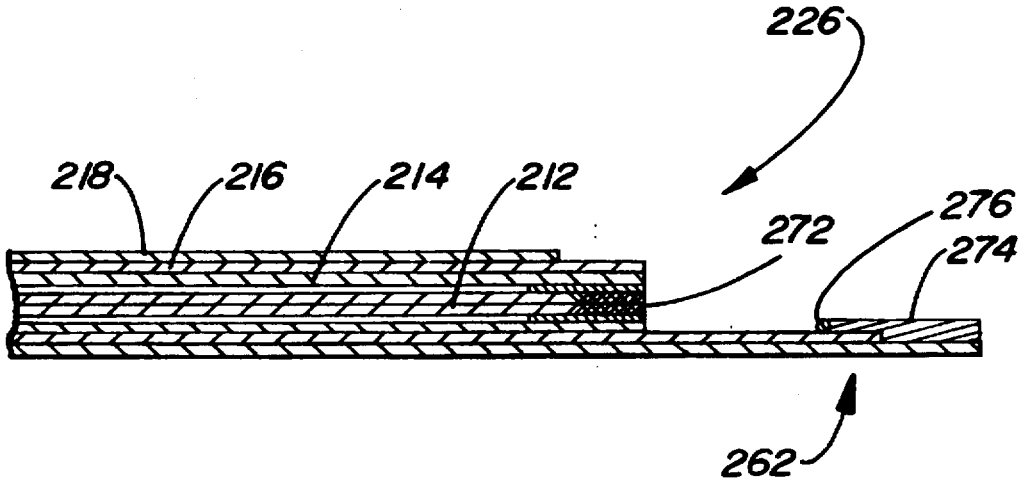
FIG. 18 is a fragmentary cross-sectional view of the factory end depicted in FIG. 15 after the processing steps depicted in FIG. 17 had been performed.
Figure 19:
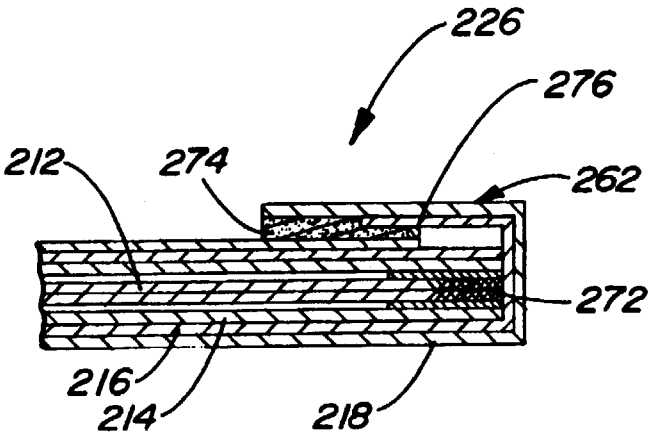
FIG. 19 is a cross-sectional view of the bag blank depicted in FIGS. 14–18 after the processing steps depicted in FIG. 17 had been performed.
Figure 19:
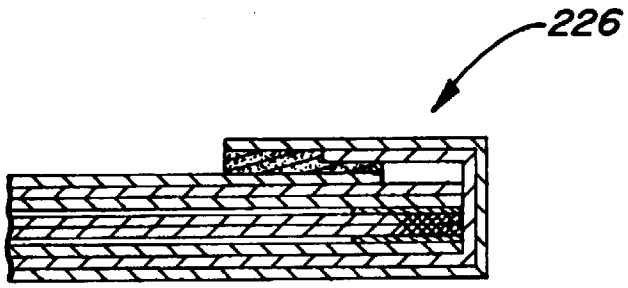
Figure 19:
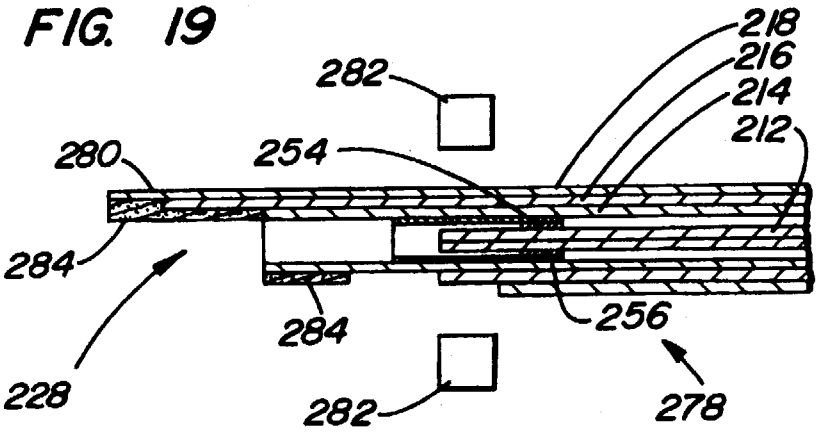

FIGS. 17–19 diagrammatically depict the process that is preferably used according to the second embodiment to close the factory end 226 at the factory before a factory completed closure 278, shown in FIG. 19, is shipped to the customer. Looking first to FIG. 17, a lip portion 262, which constitutes a lower end portion 258 of second ply 216 and a lower end portion 260 of third ply 218, is folded down away from an end portion 264 of inner tube 212 and an end portion 266 of first ply 214. At this point, the end portion 264 of inner tube 212 and the end portion 266 of first ply 214 are both severed from the inner tube 212 and first ply 214, respectively. Subsequently, a pair of heat applicators 270 are pressed against the outer surface of second ply 216 and/or first ply 214. Heat from the heat applicators 270 will cause the end of inner tube 212 to fuse closed in a heat sealed end portion 272, as is shown in FIG. 17. During this heating and fusing process, the thermoplastic material from which inner tube 212 is made is prevented from adhering to the inner surface of the end portion 266 of first ply 214 by first release coat 250. After heat applicators 270 are withdrawn, lip portion 262 is folded back up to its original position, leaving the factory end 226 configured as depicted in FIG. 18. A hot melt adhesive 274 is applied to the upper surface of lip portion 262, and a tear string 276 is inserted at the inward boundary of the hot melt adhesive 274. Lip portion 262 is then folded up and secured to the outer surface of the top side of third ply 218, as shown in FIG. 19.

A hot melt adhesive 284 is then pre-applied to the lower surface of a customer lip portion 280, which includes the outwardly extending upper side portion of the first, second and third plies 214, 216, 218. At this point, tube blank 210 is a factory completed closure 278 that is in a condition that is suitable for shipping to the customer.

Figure 20:
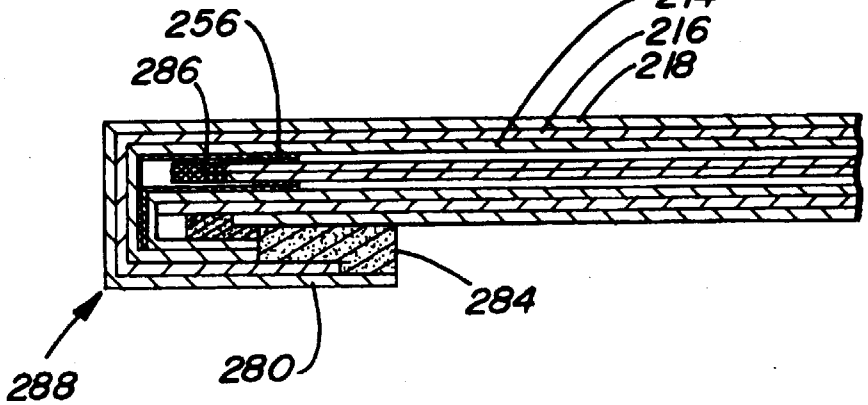
FIG. 20 is a fragmentary cross-sectional view of the bag blank depicted in FIGS. 14–19, after additional processing steps have been performed on the customer end portion that is depicted in FIG. 16.

FIGS. 19 and 20 depict the process that is used to close the customer end 228 of the factory completed closure 278 at the customer's facility. At this point, inner tube 212 will have been filled with material for shipping to a consumer. First, heat is applied by a pair of heat applicators 282 through first and second plies 214, 216 and through second release coat 254 to fuse the customer end portion of inner tube 212 closed in a heat sealed end portion 286. The presence of second release coat 254 prevents the thermoplastic material from which inner tube 212 is fabricated from adhering to the inner surface of first ply 214 during this step.

Hot air is then blown on the customer lip portion 280, which melts the hot melt adhesive 284. The customer lip portion is then folded over in the manner that is shown in FIG. 20, so that customer lip portion 280 is securely adhered to the outside surface of third ply 218. FIG. 20 depicts a completed consumer-ready closure 288 that has been manufactured according to the method herein described.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making a factory end for a bag assembly in which a removable plastic bag will be contained within a protective outer bag, comprising the steps of:

(a) providing a tube assembly having a plastic inner tube within an outer tube;

(b) sealing one end of the plastic inner tube so as to be closed at said one end; and (c) closing the outer tube about said closed one end of said inner tube in such a manner that no plastic material from said inner tube is permanently affixed to the outer tube, whereby the outer tube may be efficiently recycled or incinerated after it is separated from the inner tube by a consumer.

2. A method according to claim 1, wherein step (b) is performed by applying heat to said one end of said plastic tube to heat seal said one end closed.

3. A method according to claim 2, wherein said outer tube comprises more than one ply of non-plastic material, and said method further comprises the step of folding at least one ply of said non-plastic material away from said inner tube prior to step (b).

4. A method according to claim 3, further comprising the step of severing an end portion of said inner tube from said inner tube after said at least one ply of said non-plastic material is folded away from said inner tube.

5. A method according to claim 4, wherein said severing step further comprises severing a portion of an inner ply of said outer tube from said outer tube after said folding step.

6. A method according to claim 1, wherein step (c) comprises folding an end portion of said outer tube over said closed one end of said inner tube and sealing said end portion in the folded over position, said folding being performed so that no plastic material from said inner tube will be pinched or otherwise trapped within said folded end portion.

7. A method according to claim 1, wherein said tube assembly in step (a) is constructed and arranged so that a first side of said outer tube is stepped with respect to a second side of said outer tube in such a manner that said first side protrudes outwardly at one end of said tube assembly than it does at said second side.

8. A method according to claim 7, wherein step (c) comprises folding the protruding portion of said first side over and sealing said protruding portion to said second side of said outer tube, said folding being performed so that no plastic material from said inner tube will be pinched or otherwise trapped within said folded end portion.

9. A method according to claim 8, further comprising the step of trimming said outer tube at a second end of said tube assembly which is opposite said first end so that said second end is not stepped in the manner of said first end.

* * * * *